US008622533B2

(12) United States Patent
Takahashi

(10) Patent No.: US 8,622,533 B2
(45) Date of Patent: Jan. 7, 2014

(54) INKJET RECORDING APPARATUS AND METHOD FOR REMOVING AIR BUBBLES IN INKJET RECORDING APPARATUS

(71) Applicant: Kyocera Document Solution Inc., Osaka (JP)

(72) Inventor: So Takahashi, Osaka (JP)

( * ) Notice: Subject to any disclaimer, the term of this patent is extended or adjusted under 35 U.S.C. 154(b) by 0 days.

(21) Appl. No.: 13/753,481

(22) Filed: Jan. 29, 2013

(65) Prior Publication Data

US 2013/0194361 A1 Aug. 1, 2013

(30) Foreign Application Priority Data

Jan. 31, 2012 (JP) ..... 2012-017754

(51) Int. Cl.
*B41J 2/175* (2006.01)

(52) U.S. Cl.
USPC ..... 347/89; 347/85

(58) Field of Classification Search
USPC ..... 347/7, 65–67, 84–87, 89, 92
See application file for complete search history.

(56) References Cited

U.S. PATENT DOCUMENTS

| | | | | |
|---|---|---|---|---|
| 5,231,424 | A * | 7/1993 | Kaneko et al. | 347/29 |
| 6,443,560 | B1 * | 9/2002 | Okano et al. | 347/55 |
| 7,252,361 | B2 * | 8/2007 | Nishikawa et al. | 347/22 |
| 7,399,075 | B2 * | 7/2008 | Nomura et al. | 347/89 |
| 8,042,902 | B2 * | 10/2011 | Katada | 347/17 |

FOREIGN PATENT DOCUMENTS

| | | |
|---|---|---|
| JP | 2007-216442 A | 8/2007 |
| JP | 2011-079251 A | 4/2011 |

* cited by examiner

*Primary Examiner* — Anh T. N. Vo
(74) *Attorney, Agent, or Firm* — Ariel S. Bentolila; Bay Area IP Group, LLC

(57) ABSTRACT

An inkjet recording apparatus is capable of an operation of removing air bubbles in a recording head that includes the ink supply step, the ink ejection step, and the refilling step. The ink supply step supplies ink to a common flow-passage in the state in which movement of the ink inside a second ink-flow passage is tolerated with an inflow side valve, and movement of the ink inside a third ink-flow passage is restricted with an outflow side valve. The ink ejection step ejects the ink together with the air bubbles inside the common flow-passage from an outflow port into the third ink-flow passage by tolerating movement of the ink inside the third ink-flow passage with the outflow side valve. The refilling step refills the ink in the state in which movement of the ink inside the second ink-flow passage is restricted with the inflow side valve.

17 Claims, 13 Drawing Sheets

INKJET RECORDING APPARATUS AND METHOD FOR REMOVING AIR BUBBLES IN INKJET RECORDING APPARATUS

INCORPORATION BY REFERENCE

This application is based upon and claims the benefit of priority from Japanese Unexamined Patent Application Publication No. 2012-017754, filed Jan. 31, 2012, the entire contents of which are incorporated herein by reference.

BACKGROUND

Field

The present invention relates to an inkjet recording apparatus which, in a piece of recording equipment, such as a facsimile, a copying machine, or a printer, performs recording by discharging ink onto a record medium, such as a paper sheet, and particularly relates to recovery of a recording head, which discharges ink.

Recording apparatuses, such as facsimiles, copying machines, and printers, are configured to record an image on a record medium, such as a paper, cloth, or OHP sheet, and according to method of recording, they can be classified into inkjet type, wire dot type, thermal type, etc. Further, the inkjet recording method is available as, for example, a serial type and a line head type. With the inkjet recording method of serial type, recording is performed while the recording head scans the record medium, for example. With the inkjet recording method of line head type, recording is performed by, for example, the single pass method (one pass method). In the inkjet recording apparatus using the inkjet recording method of line head type, recording heads in the form of a line are for example, fixed in, the apparatus main body.

For example, with the inkjet recording apparatus of line head type, a feeding means, such as a feeding belt provided in the apparatus main body feeds the record medium, such as a paper sheet, while the respective nozzles in the line heads having a recording width larger than the width of the record medium discharge the ink, thereby an image being formed on the record medium. Thus, printing at high speed can be accomplished, as compared to the serial type inkjet recording apparatus, in which the recording head makes a reciprocating operation along the direction of width of the record medium.

With such an inkjet recording apparatus, if an air bubble is generated in the ink-flow passage, and the generated air bubble is introduced into a nozzle in the recording head, discharging ink from the nozzle is made impossible, thereby the printing operation cannot be performed.

Then, as the method for removing air bubbles in the ink, an ink supply apparatus is known which performs an operation of circulating the ink by, prior to supplying the ink from the main tank to the sub-tank, sucking up the ink from the bottom portion of the main tank to circulate the ink back to the main tank through the sub-tank.

Further, a droplet discharge head is known which includes a plurality of droplet discharge portions; a common supply passage for supplying the liquid to the supply passage of the respective droplet discharge portions; and a common recovery passage for recovering the liquid from the recovery passage of the respective droplet discharge portions in which a dead water region is formed, a reserving portion for reserving the air bubbles being provided in the dead water region, whereby a pressure fluctuation generated in the pressure chamber in the droplet discharge portion can be more easily propagated to the common recovery passage.

SUMMARY

An inkjet recording apparatus in accordance with one aspect of the present invention includes a recording head, an ink tank, a pump mechanism, a circulation flow passage, an inflow side valve, an outflow side valve, and a damper portion. The recording head has a common flow-passage having an inflow port at one end and an outflow port at the other end, and a plurality of nozzles communicating with the common flow-passage and discharging ink onto a record medium. The ink tank reserves the ink to be discharged onto the record medium. The pump mechanism sucks the ink inside the ink tank, and supplies the ink to the recording head. The circulation flow passage has a first ink-flow passage connecting between the pump mechanism and the ink tank, a second ink-flow passage connecting between the pump mechanism and the inflow port of the recording head, and a third ink-flow passage connecting between the outflow port of the recording head and the ink tank. The inflow side valve is provided in the second ink-flow passage. The outflow side valve is provided in the third ink-flow passage. The damper portion is formed in the ink-flow passage from the inflow side valve to the outflow side valve, buffering a change in internal pressure caused by an operation of the pump mechanism. And, the inkjet recording apparatus is capable of implementing an operation of removing air bubbles in the recording head, which includes: the ink supply step of supplying the ink to the common flow-passage by using the pump mechanism for pressurizing the ink in the state in which movement of the ink inside the second ink-flow passage is tolerated with the inflow side valve, and movement of the ink inside the third ink-flow passage is restricted with the outflow side valve; the ink ejection step of ejecting, after start of the ink supply step, the ink together with the air bubbles inside the common flow-passage from the outflow port into the third ink-flow passage by tolerating movement of the ink inside the third ink-flow passage with the outflow side valve; and the refilling step of, after termination of the ink ejection step, refilling the ink into the pump mechanism from the ink tank through the first ink-flow passage in the state in which movement of the ink inside the second ink-flow passage is restricted with the inflow side valve.

A method for removing air bubbles in an inkjet recording apparatus in accordance with another aspect of the present invention provides the ink supply step, the ink ejection step, and the refilling step for an inkjet recording apparatus including a recording head, an ink tank, a pump mechanism, a circulation flow passage, an inflow side valve, and an outflow side valve. The recording head has a common flow-passage having an inflow port at one end and an outflow port at the other end, and a plurality of nozzles communicating with the common flow-passage. The pump mechanism supplies ink inside the ink tank to the recording head. The circulation flow passage has a first ink-flow passage connecting between the pump mechanism and the ink tank, a second ink-flow passage connecting between the pump mechanism and the inflow port of the recording head, and a third ink-flow passage connecting between the outflow port of the recording head and the ink tank. The inflow side valve is provided in the second ink-flow passage. The outflow side valve is provided in the third ink-flow passage. The ink supply step supplies the ink to the common flow-passage by using the pump mechanism for pressurizing the ink in the state in which movement of the ink inside the second ink-flow passage is tolerated with the inflow side valve, and movement of the ink inside the third ink-flow passage is restricted with the outflow side valve. The ink ejection step ejects, after start of the ink supply step, the ink inside the common flow-passage together with the air bubbles from the outflow port into the third ink-flow passage by tolerating movement of the ink inside the third ink-flow passage with the outflow side valve. The refilling step refills, after termination of the ink ejection step, the ink from the ink tank into the pump mechanism through the first ink-flow passage in the state in which movement of the ink inside the second ink-flow passage is restricted with the inflow side valve.

An inkjet recording apparatus in accordance with another aspect of the present invention includes a recording head, an ink tank, a pump mechanism, a circulation flow passage, an inflow side valve, and an outflow side valve. The recording head has a common flow-passage having an inflow port at one end and an outflow port at the other end, and a plurality of nozzles communicating with the common flow-passage. The pump mechanism supplies ink inside the ink tank to the recording head. The circulation flow passage has a first ink-flow passage connecting between the pump mechanism and the ink tank, a second ink-flow passage connecting between the pump mechanism and the inflow port of the recording head, and a third ink-flow passage connecting between the outflow port of the recording head and the ink tank. The inflow side valve is provided in the second ink-flow passage. The outflow side valve is provided in the third ink-flow passage. And, the ink supply step of supplying the ink to the common flow-passage by using the pump mechanism for pressurizing the ink in the state in which movement of the ink inside the second ink-flow passage is tolerated with the inflow side valve, and movement of the ink inside the third ink-flow passage is restricted with the outflow side valve, the ink ejection step ejects, after start of the ink supply step, the ink inside the common flow-passage together with the air bubbles from the outflow port into the third ink-flow passage by tolerating movement of the ink inside of the third ink-flow passage with the outflow side valve, and the refilling step of refilling, after termination of the ink ejection step, the ink from the ink tank into the pump mechanism through the first ink-flow passage in the state in which movement of the ink inside the second ink-flow passage is restricted with the inflow side valve can be implemented.

DETAILED DESCRIPTION OF THE EMBODIMENT

Figure 1:
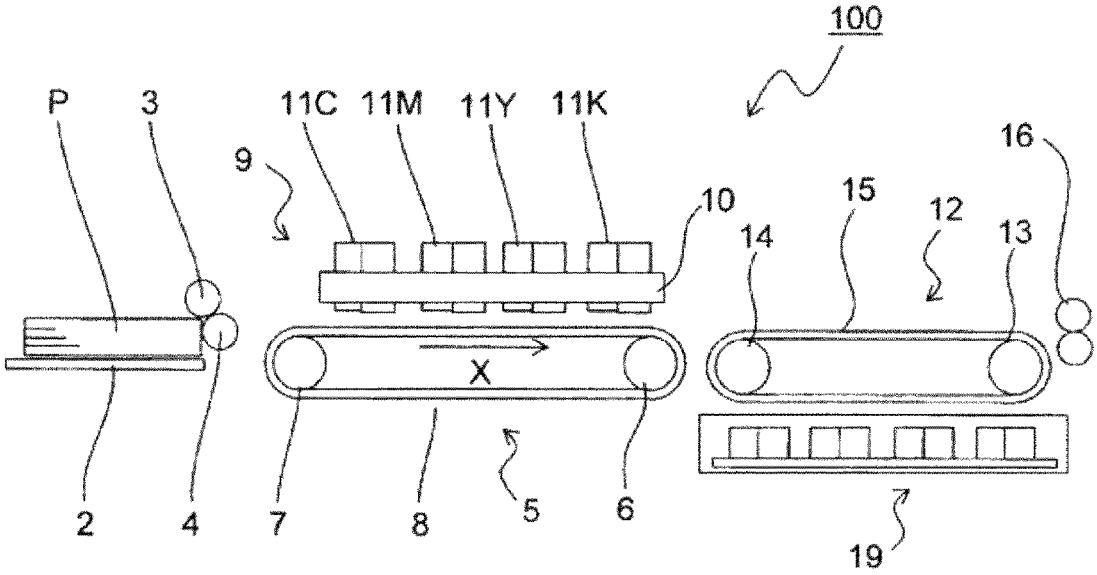
FIG. 1 is a side view schematically showing the structure of an inkjet recording apparatus 100 according to one embodiment of the present invention.
Figure 2:
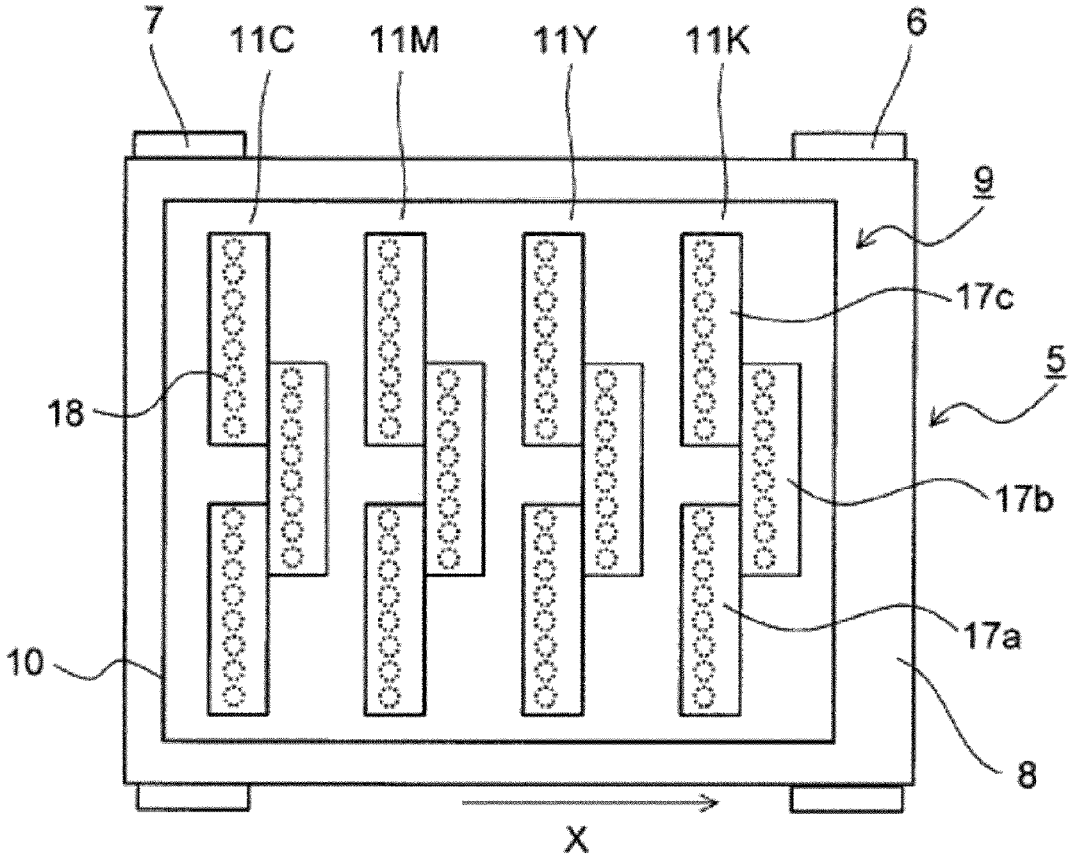
FIG. 2 is a plan view of a first conveyance unit 5 and a recording unit 9 of the inkjet recording apparatus 100 shown in FIG. 1 when viewed from the top.

Hereinbelow, an embodiment of the present invention will be explained with reference to the drawings. FIG. 1 is a side view schematically showing the structure of an inkjet recording apparatus 100 in accordance with the present invention, and FIG. 2 is a plan view of a first conveyance unit 5 and a recording unit 9 of the inkjet recording apparatus 100 shown in FIG. 1 when viewed from the top.

As shown in FIG. 1, in the left side portion of the inkjet recording apparatus 100, a pick-up tray 2 for accommodating paper sheets P (record media) is provided. At one end of this pick-up tray 2, there are provided a pick-up roller 3 for picking up the accommodated paper sheets P one by one sequentially from the top-positioned paper sheet P and feeding it to a first conveyance unit 5 later described, and a driven roller 4 which is butted against the pick-up roller 3 and driven thereby to be rotated.

On the downstream side (the right side in FIG. 1) of the pick-up roller 3 and driven roller 4 in the paper sheet conveyance direction, the first conveyance unit 5 and the recording unit 9 are disposed. The first conveyance unit 5 includes a first driving roller 6 which is disposed on the downstream side in the paper sheet conveyance direction, a first driven roller 7 which is disposed on the upstream side in the paper sheet conveyance direction, and a first feeding belt 8 which is installed on the first driving roller 6 and the first driven roller 7. With the first driving roller 6 being driven to be rotated in a clockwise direction, the paper sheet P held by the first feeding belt 8 is fed in the paper sheet conveyance direction.

Note that the first driving roller 6 is disposed on the downstream side in the paper sheet conveyance direction, thereby the feeding surface (the upper surface in FIG. 1) of the first feeding belt 8 being pulled by the first driving roller 6, which allows the tension of the feeding surface of the first feeding belt 8 to be increased, and thus stable feeding of the paper sheet P to be made. As the first feeding belt 8, a sheet made of a dielectric resin may be used, and mainly a belt having no seams (a seamless belt) may be used.

The recording unit 9 includes a head housing 10, and line heads 11C, 11M, 11Y, and 11K which are held by the head housing 10. These line heads 11C to 11K are supported at a level where a predetermined spacing (for example, 1 mm) with respect to the feeding surface of the first feeding belt 8 is given, and as shown in FIG. 2, a plurality of (herein three) recording heads 17*a* to 17*c* are arranged zigzag along the paper sheet width direction (in a vertical direction in FIG. 2) which is orthogonal to the paper sheet conveyance direction.

The line heads 11C to 11K have a width larger than the width of the paper sheet P fed, and can discharge the ink from a nozzle 18 corresponding to a printing position onto the paper sheet P which is fed on the first feeding belt 8. Further, the respective recording heads 17*a* to 17*c* are disposed such that a part of the nozzles 18 provided in each of them are duplicated in the feeding direction.

The recording heads 17*a* to 17*c* constituting the respective line heads 11C to 11K are supplied with ink having a color specified for the respective line heads 11C to 11K from one of the tanks (not shown) of inks having four different colors (cyan, magenta, yellow and black).

The respective recording heads 17*a* to 17*c* discharge the ink from the nozzle 18 onto the paper sheet P which is fed, being adsorbed to the feeding surface of the first feeding belt 8 to be held thereby, according to image data received from an external computer, or the like. Thereby, on the paper sheet P on the first feeding belt 8, there is formed a color image in which the inks of the four colors of cyan, magenta, yellow, and black are superposed one upon another.

Further, at the time of starting the printing following the downtime over a long period of time, the purging operation, which discharges the ink having an increased viscosity from the nozzle 18, is executed for the nozzles 18 in all the recording heads 17*a* to 17*c*, and at an interval between printing operations, the purging operation is made for any nozzles 18 in the recording heads 17*a* to 17*c* with which the amount of ink discharge has been lowered below a predetermined value, thereby the recording heads 17*a* to 17*c* being prepared for the subsequent printing operation. Thus, poor discharge of the ink due to, for example, drying or clogging of the recording heads 17*a* to 17*c* can be suppressed.

On the downstream side (the right side in FIG. 1) of the first conveyance unit 5 in the paper sheet conveyance direction, a second conveyance unit 12 is disposed. The second conveyance unit 12 is configured to include a second driving roller 13 which is disposed on the downstream side in the paper sheet conveyance direction, a second driven roller 14 which is disposed on the upstream side in the paper sheet conveyance direction, and a second feeding belt 15 which is installed on the second driving roller 13 and the second driven roller 14, and with the second driving roller 13 being driven to be rotated in a clockwise direction, the paper sheet P held by the second feeding belt 15 is fed in the paper sheet conveyance direction.

The paper sheet P on which an ink image is recorded by the recording unit 9 is fed to the second conveyance unit 12, and while being passed through the second conveyance unit 12, the inks discharged on the surface of the paper sheet P are dried. Further, under the second conveyance unit 12, a maintenance unit 19 is disposed. The maintenance unit 19 is moved to under the recording unit 9 when the above-mentioned purging operation is executed, and wipes off the inks discharged from the nozzles 18 in the recording heads 17 to recover the inks.

On the downstream side of the second conveyance unit 12 in the paper sheet conveyance direction, there is provided a delivery roller pair 16 for delivering the paper sheet P on which the image is recorded, to the outside of the apparatus main body, and on the downstream side of the delivery roller pair 16, there is provided a delivery tray (not shown) on which the paper sheets P delivered to the outside of the apparatus main body are stacked.

Figure 3:
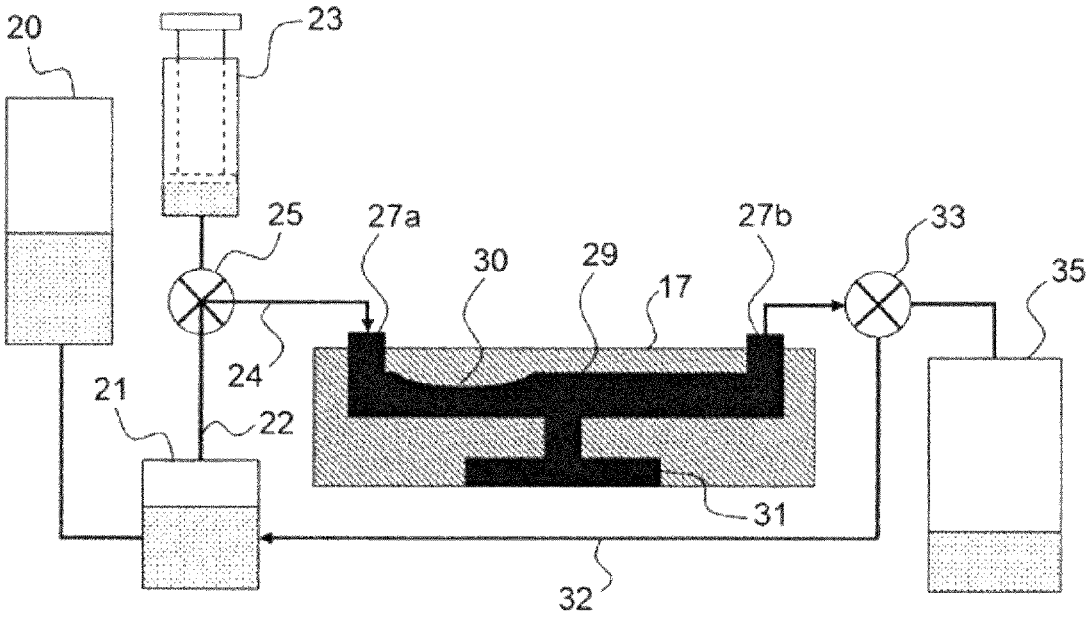
FIG. 3 is a drawing schematically showing an ink-flow passage of the inkjet recording apparatus 100 of the present invention.
Figure 4:
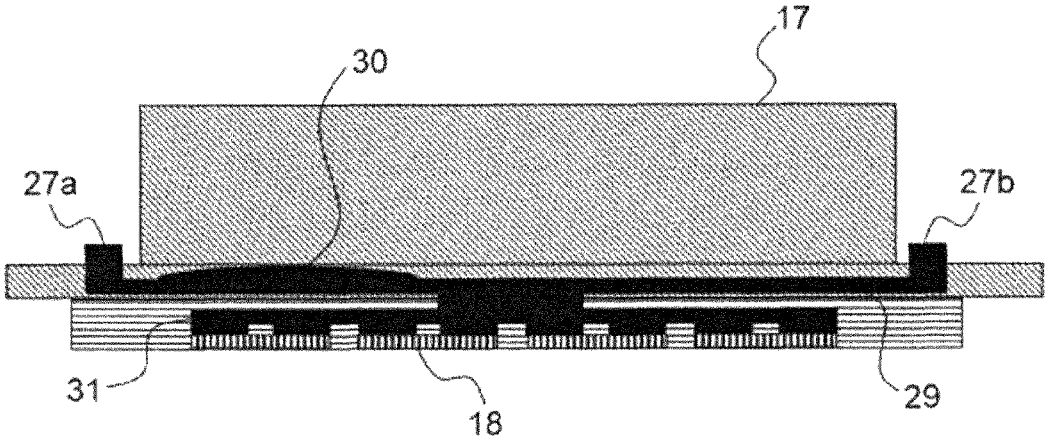
FIG. 4 is a drawing schematically showing the internal structure of a recording head 17.

FIG. 3 is a drawing schematically showing an ink-flow passage of the inkjet recording apparatus 100 according to the embodiment of the present invention, and FIG. 4 is a sectional view schematically showing the internal structure of the recording head 17. Between the main tank 20 for the respective colors and the recording head 17, the ink-flow passage shown in FIG. 3 is provided, respectively, however, the ink-flow passage for a particular color will be explained here. In addition, the recording heads 17*a* to 17*c* are expressed as the recording head 17, the symbols 17*a* to 17*c* being abbreviated to 17.

As shown in FIG. 3, between the main tank 20 and the recording head 17, a sub-tank 21 and a syringe pump 23 are disposed, and the sub-tank 21 and the syringe pump 23 are connected to each other by a first ink-flow passage 22 formed of a tubing member. An inflow port 27*a* of the recording head 17 and the syringe pump 23 are connected to each other by a second ink-flow passage 24 formed of a tubing member, and the second ink-flow passage 24 is connected to the first ink-flow passage 22 through an inflow side valve 25 constituted by a three-way valve.

On the other hand, an outflow port 27*b* of the recording head 17 and the sub-tank 21 are connected to each other by a third ink-flow passage 32 formed of a tubing member, and in the third ink-flow passage 32, an outflow side valve 33 constituted by a three-way valve is provided. In addition, to the third ink-flow passage 32, a waste fluid tank 35 is connected through the outflow side valve 33. The first ink-flow passage 22, the second ink-flow passage 24, and the third ink-flow passage 32 form a circulation flow passage which connects the recording head 17, the sub-tank 21, and the syringe pump 23 to one another.

As shown in FIG. 4, in the recording head 17, a common flow-passage 29 ranging from the inflow port 27*a* to the outflow port 27*b* is provided, and in the portion of the common flow-passage 29 that is closer to the inflow port 27*a*, a damper portion 30 is formed. With the damper portion 30, a part of the inner wall of the common flow-passage 29 is formed of a flexible film, and when the internal pressure of the common flow-passage 29 is raised, the damper portion 30 is inflated outward, while, when the internal pressure is lowered, the damper portion 30 becomes dented, thereby an abrupt change in internal pressure of the common flow-passage 29 can be buffered. In the present embodiment, the damper portion 30 is provided between the inflow port 27*a* and the outflow port 27*b* of the recording head 17, however, the damper portion 30 may be disposed outside of the recording head 17, provided that it is placed between the inflow side valve 25 and the outflow side valve 33.

Further, a branch passage 31 is provided which is branched downward from the common flow-passage 29, being led to the respective nozzles 18. For example, in a case where the recording head 17 is a piezoelectric inkjet head which transmits a pressure change caused by a deformation of a piezoelectric element (not shown) to the ink in the nozzle 18 to fluctuate the meniscus, thereby generating an ink drop, a voltage having a predetermined driving waveform is applied to the piezoelectric element to thereby discharge a predetermined amount of ink from the nozzle 18 corresponding to printing data.

Figure 5:
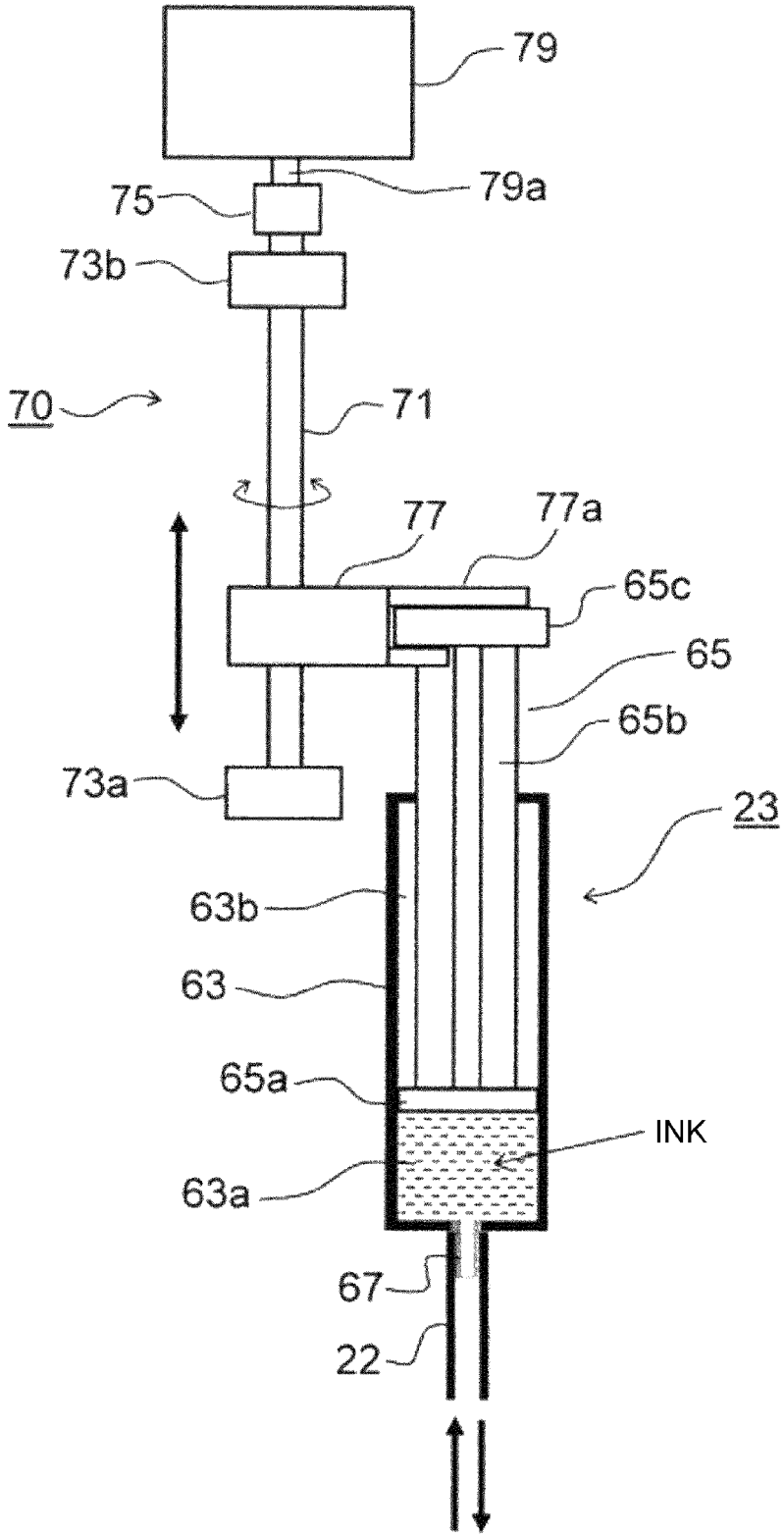
FIG. 5 is a drawing schematically showing a syringe pump 23 and a driving apparatus 70.

FIG. 5 is a drawing schematically showing the syringe pump 23 and a driving apparatus 70 for the syringe pump 23 which are used in the present embodiment. As shown in FIG. 5, the syringe pump 23 includes a cylinder 63 and a piston 65. The piston 65 has a piston portion 65*a*, which is formed at the lower end of a piston rod 65*b*. Further, the upper end of the piston rod 65*b* is extended to above the top wall of the cylinder 63, and in the extended end portion of the piston rod 65*b*, a flange portion 65*c* is formed.

Further, there is protruded downward from the lower end face of the cylinder 63 a supply/ejection portion 67, which is hollow cylindrical, being communicated with the cylinder 63. The supply/ejection portion 67 is connected with the first ink-flow passage 22, and the ink inside the sub-tank 21 (refer to FIG. 3) is caused to flow into the cylinder 63 through the supply/ejection portion 67, while the ink inside the cylinder 63 is ejected through the supply/ejection portion 67, the ejected ink being supplied to the recording head 17 (refer to FIG. 3) through the second ink-flow passage 24.

On the other hand, the piston 65 of the syringe pump 23 can be vertically moved by the driving apparatus 70. The driving apparatus 70 has a ball screw 71, a nut portion 77, and a drive motor 79. The ball screw 71 is disposed substantially in parallel with the cylinder 63 (in a vertical direction) in the vicinity of the flange portion 65*c* of the piston 65. The lower end portion and the upper end portion of the ball screw 71 are rotatably supported by ball screw supporting members 73*a* and 73*b*.

Further, the upper end portion of the ball screw 71 is extended to above the ball screw supporting member 73*b*, the extended end portion being provided with a coupling 75. The coupling 75 is connected with a rotating shaft 79*a* of the drive motor 79 such that the ball screw 71 is rotated with the drive motor 79 being run. Further, the drive motor 79 can be run either forward or backward. The ball screw 71 is operatively engaged with the nut portion 77, and with the ball screw 71 being rotated, the nut portion 77 is moved upward or downward depending upon the direction of rotation.

Further, in the nut portion 77, there is formed a fixing portion 77*a* which includes two plate-like members, being protruded toward the piston 65, and the fixing portion 77*a* sandwiches the flange portion 65*c* of the piston 65, thereby being connected to the flange portion 65*c*. Thus, with the drive motor 79 being run, the piston 65 is moved upward or downward together with the nut portion 77.

Figure 10:
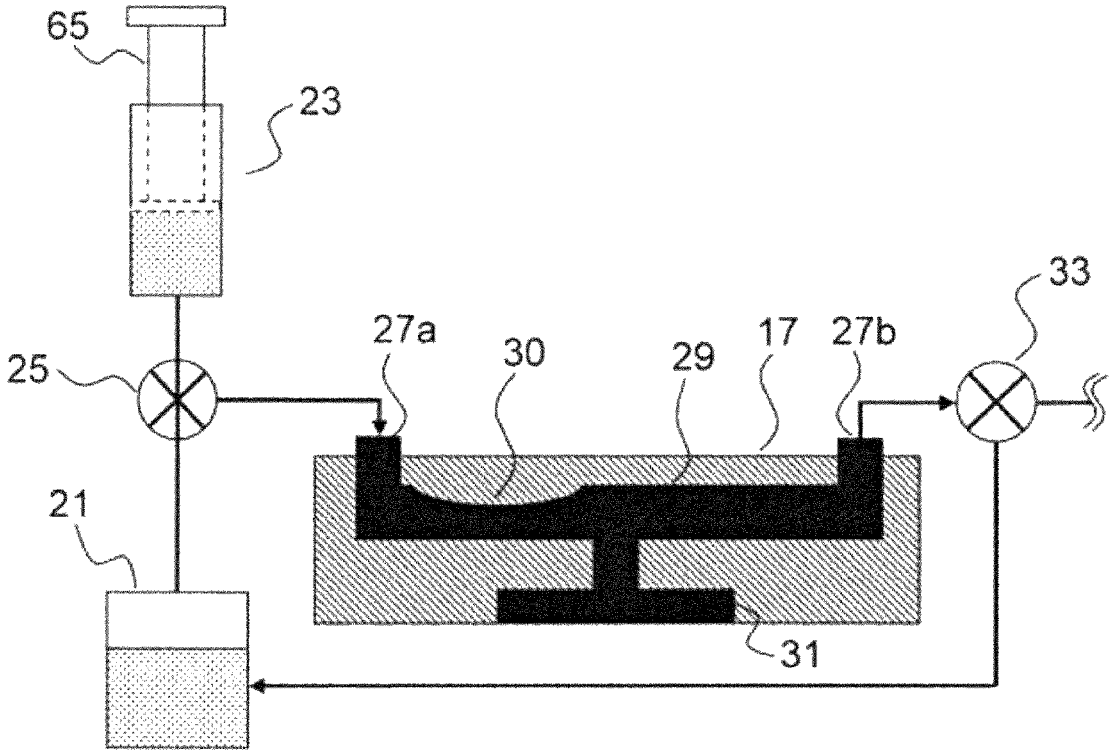
FIG. 10 is a drawing showing the state in which the syringe pump 23 is refilled with the ink and an inflow side valve 25 is switched over such that a sub-tank 21 and the recording head 17 are communicated with each other.

The relationship between the direction of running of the drive motor 79 and the direction of movement of the piston 65 is not specifically limited, and for example, it can be set such that, if the drive motor 79 is run in a clockwise direction when viewed from the top in FIG. 5, the piston 65 is moved downward (refer to FIG. 8), while if the drive motor 79 is run in a counterclockwise direction when viewed from the top in FIG. 5, the piston 65 is moved upward (refer to FIG. 10).

The cylinder 63 is partitioned into a first containing chamber 63*a* on the supply/ejection portion 67 side and a second containing chamber 63*b* on the piston rod 65*b* side by the piston portion 65*a*. Further, the ink supplied from the sub-tank 21 is contained in the first containing chamber 63*a*. On the periphery of the piston portion 65*a*, a packing (not shown), such as an O-ring, is loaded in order to prevent the ink from being leaked from the first containing chamber 63*a* to the second containing chamber 63*b*, and permit the piston portion 65*a* to be smoothly slid on the inner wall of the cylinder 63.

When the drive motor 79 is run to move the piston portion 65*a* upward (refer to FIG. 10), a negative pressure is generated in the first containing chamber 63*a* of the cylinder 63. Such negative pressure causes the ink in the sub-tank 21 to be sucked into the cylinder 63 through the inflow side valve 25, thereby a substantially predetermined quantity of ink being introduced into the first containing chamber 63*a* through the supply/ejection portion 67. On the other hand, when the drive motor 79 is run in a direction reverse to that of the above-mentioned motor running, thereby the piston portion 65*a* being moved downward, a positive pressure is generated in the first containing chamber 63*a*, and such positive pressure causes the ink to be ejected from the supply/ejection portion 67, thereby a substantially fixed quantity of ink being supplied to the recording head 17 through the inflow side valve 25 (refer to FIG. 8).

Figure 6:
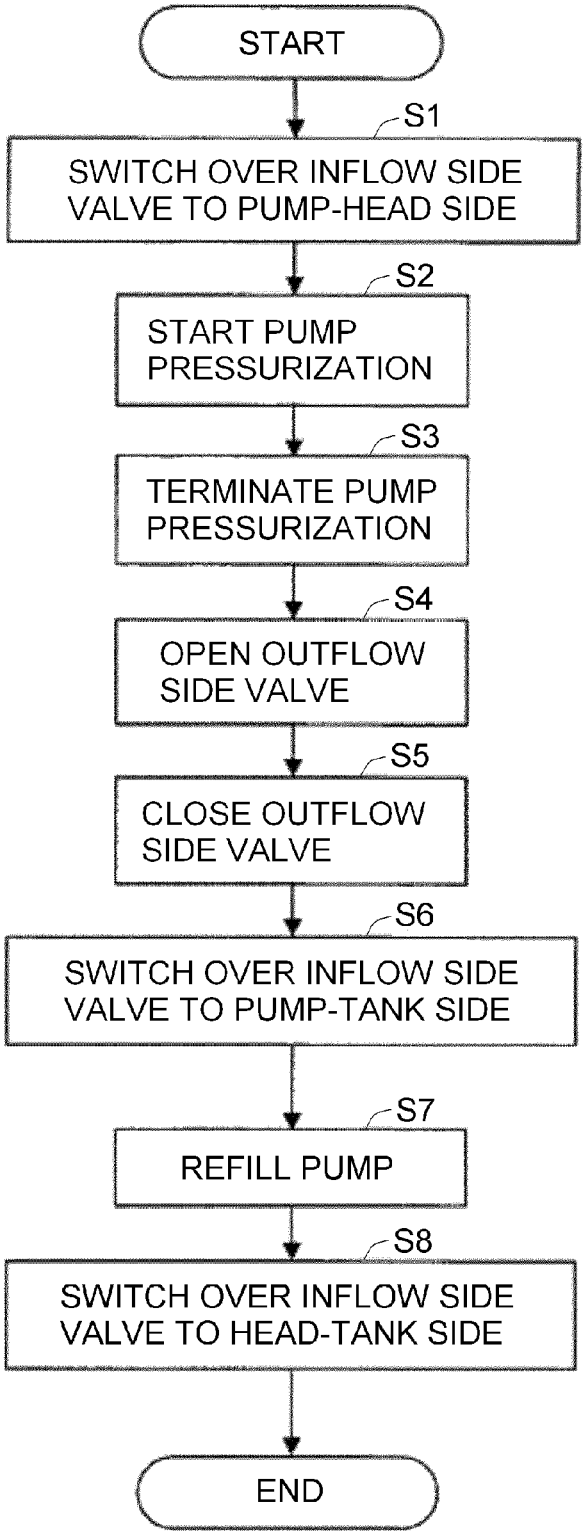
FIG. 6 is a flowchart illustrating a first sequence of steps of operation of removing air bubbles in the recording head 17.

Next, the operation of removing air bubbles in the recording head 17 will be explained. FIG. 6 is a flowchart illustrating a first sequence of steps of operation of removing air bubbles in the recording head 17, and FIG. 7 to FIG. 10 are drawings schematically showing the respective steps to be taken in an operation of removing air bubbles in the recording head 17. With reference to FIG. 7 to FIG. 10, and as required, to FIG. 1 to FIG. 5, the procedure for performing an operation of removing air bubbles in the recording head 17 will be explained along the flow of the steps in FIG. 6.

At a normal time (a printing waiting time), as shown in FIG. 3, the sub-tank 21 side of the inflow side valve 25 and the recording head 17 side thereof are communicated with each other, and a negative pressure is applied to the damper portion 30, resulting from a difference in water head between the sub-tank 21 and the recording head 17.

Figure 7:
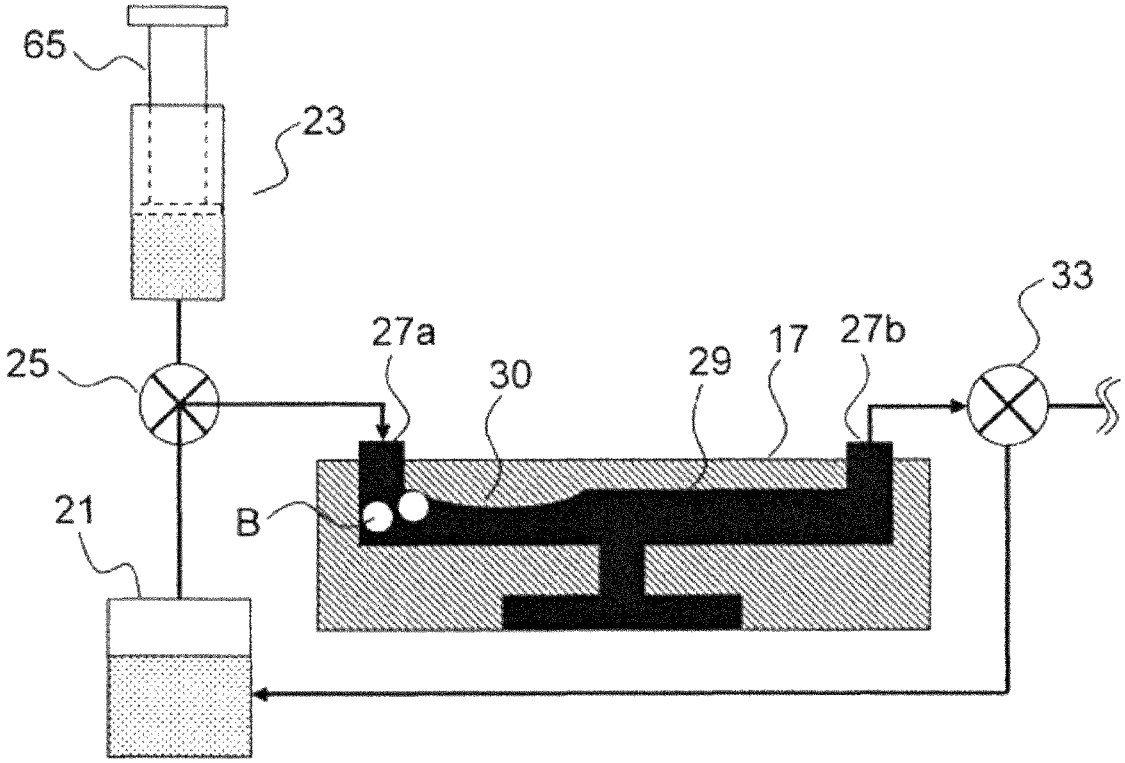
FIG. 7 is a drawing showing the state in which air bubbles are generated in a common flow-passage 29 of the recording head 17.

As shown in FIG. 7, in the event where air bubbles B are generated inside the common flow-passage 29 of the recording head 17, the inflow side valve 25 is first switched over such that the syringe pump 23 side and the recording head 17 side are communicated with each other (step S1). Next, the piston 65 in the syringe pump 23 is pressed down to pressurize the ink in the syringe pump 23 for supplying the ink from the inflow port 27*a* of the recording head 17 to the inside of the common flow-passage 29 (step S2). And, as the ink is supplied from the inflow port 27*a*, an ink flow directed toward the outflow port 27*b* is generated inside the common flow-passage 29, the air bubbles B being moved toward the outflow port 27*b* by the ink flow generated.

Figure 8:
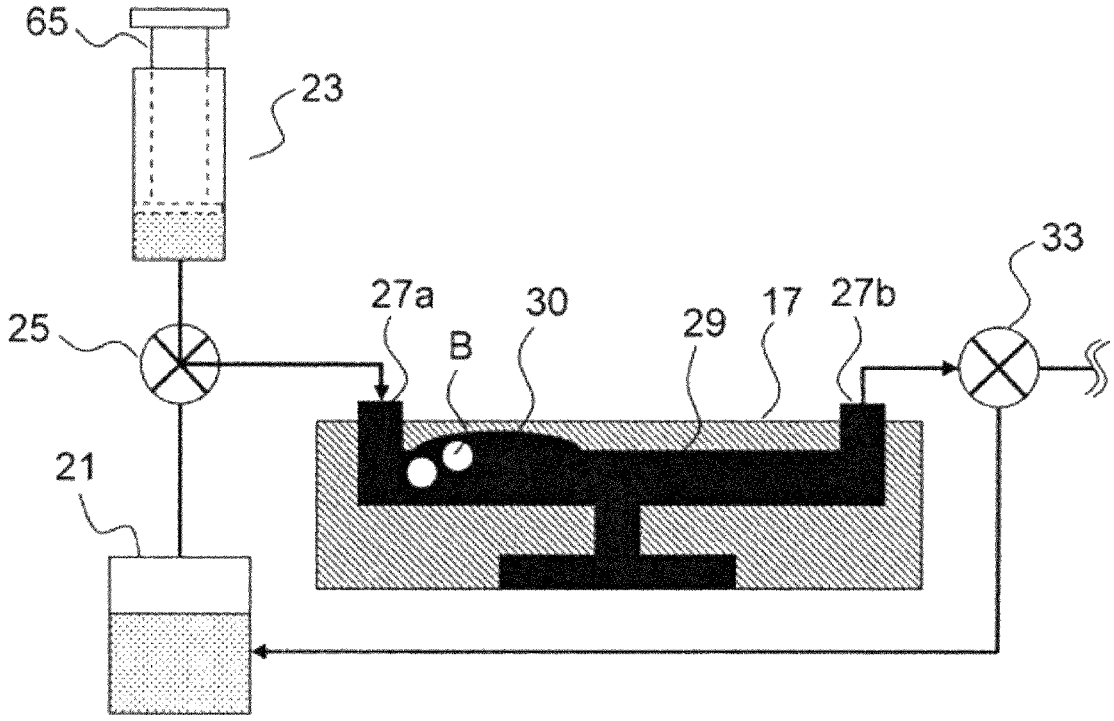
FIG. 8 is a drawing showing the state in which a damper portion 30 of the recording head 17 is inflated by supplying ink from the syringe pump 23.

At this time, the outflow side valve 33 is closed, the outflow of the ink from the outflow port 27*b* being restricted, and therefore inside the common flow-passage 29, a positive pressure is generated, however, as shown in FIG. 8, the damper portion 30 is inflated to thereby buffer an abrupt increase in internal pressure inside the common flow-passage 29 due to the ink supply from the syringe pump 23.

Figure 9:
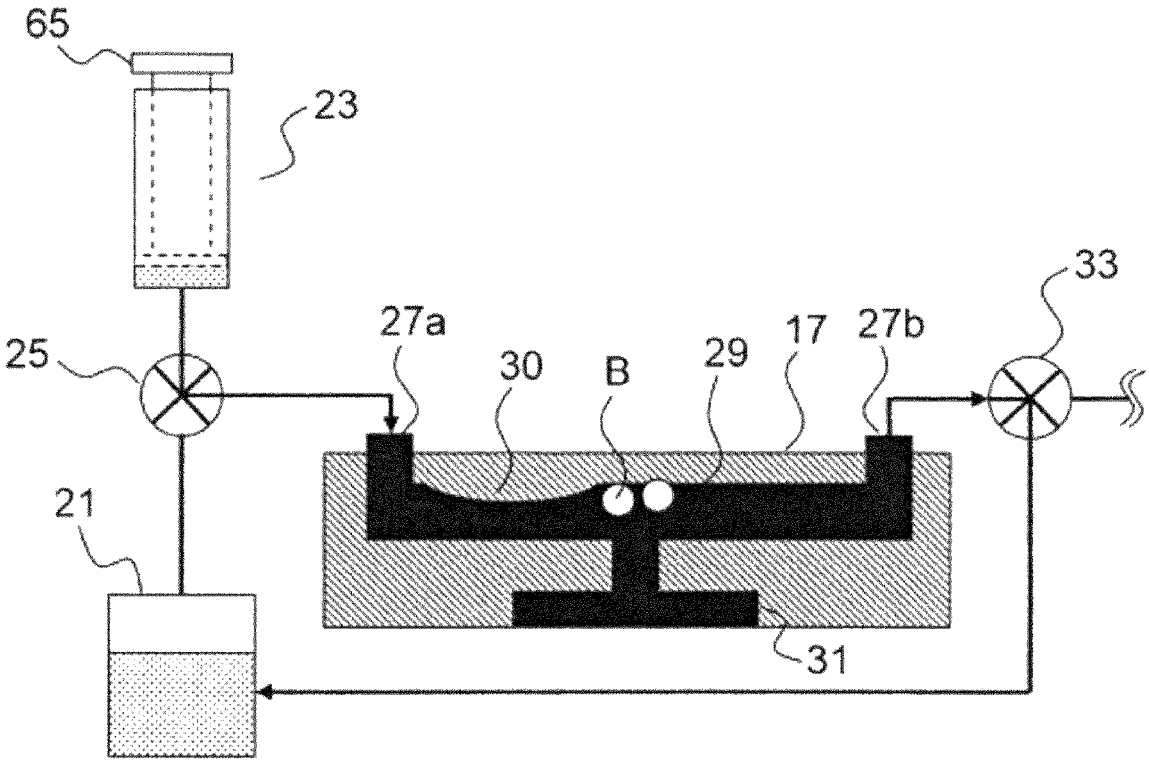
FIG. 9 is a drawing showing the state in which the ink reserved in the damper portion 30 is ejected together with the air bubbles B from an outflow port 27*b* with an outflow side valve 33 being opened.

Next, when the pressurization of the ink by the syringe pump 23 has been terminated (step S3), the outflow side valve 33 is opened (step S4). With this, as shown in FIG. 9, the pressure inside the common flow-passage 29 is released, the ink kept in the damper portion 30 being ejected from the outflow port 27*b* together with the air bubbles B. Next, the outflow side valve 33 is again closed (step S5), and the inflow side valve 25 is switched over such that the syringe pump 23 side and the sub-tank 21 side are communicated with each other (step S6).

Thereafter, as shown in FIG. 10, the piston 65 in the syringe pump 23 is pulled up to refill the syringe pump 23 with the ink (step S7), and the inflow side valve 25 is switched over such that the sub-tank 21 side and the recording head 17 side are communicated with each other (step S8), thereby the operation of removing air bubbles being completed, and the initial state shown in FIG. 3 being restored.

Note that, if, before the outflow side valve 33 is again closed after the ink supply by the syringe pump 23 having been terminated, the inflow side valve 25 were switched over such that the syringe pump 23 side and the sub-tank side are communicated with each other, a reverse flow of the ink would be generated from the inflow port 27*a* toward the syringe pump 23 side, the ink kept in the damper portion 30 being ejected into the common flow-passage 29 with the pressure inside the common flow-passage 29 being released and the damper portion 30 being contracted. And, as a result of this, the air bubbles B which could not have been carried away from the outflow port 27*b* would also flow upstream from the inflow port 27*a*.

Accordingly, by taking the above procedure for performing an operation of removing air bubbles in the recording head 17, there will occur no reverse flow of the ink from the inflow port 27*a* toward the syringe pump 23 side. Thus, the air bubbles B inside the common flow-passage 29 can be reliably carried away from the outflow port 27*b*. The ink which has been carried away together with the air bubbles B from the outflow port 27*b* are returned to the sub-tank 21 through the third ink-flow passage 32. While the ink is being reserved in the sub-tank 21, the air bubbles B in the ink get out of the liquid surface, and therefore, there is no possibility that the ink including air bubbles is supplied to the recording head 17 from the sub-tank 21 through the syringe pump 23.

Further, since, after the ink inside the common flow-passage 29 has been ejected from the outflow port 27*b* into the third ink-flow passage 32 together with the air bubbles B, the outflow side valve 33 is closed before the inflow side valve 25 is switched over such that the syringe pump 23 side and the sub-tank 21 side are communicated with each other, reverse flowing of the ink inside the third ink-flow passage 32 into the common flow-passage 29 at the time of the inflow side valve 25 being switched over can be suppressed.

As the timing when the outflow side valve 33 is to be opened, it may be any time after the ink supply by the syringe pump 23 is terminated and before the inflow side valve 25 is switched over, and the outflow side valve 33 can be opened immediately (in a few seconds) after the pressurization of the ink by the syringe pump 23 having been terminated. Alternatively, for example, like a second sequence of steps illustrated in FIG. 11, the outflow side valve 33 can be opened simultaneously with the termination of the pressurization of the ink by the syringe pump 23 (step S3).

Figure 11:
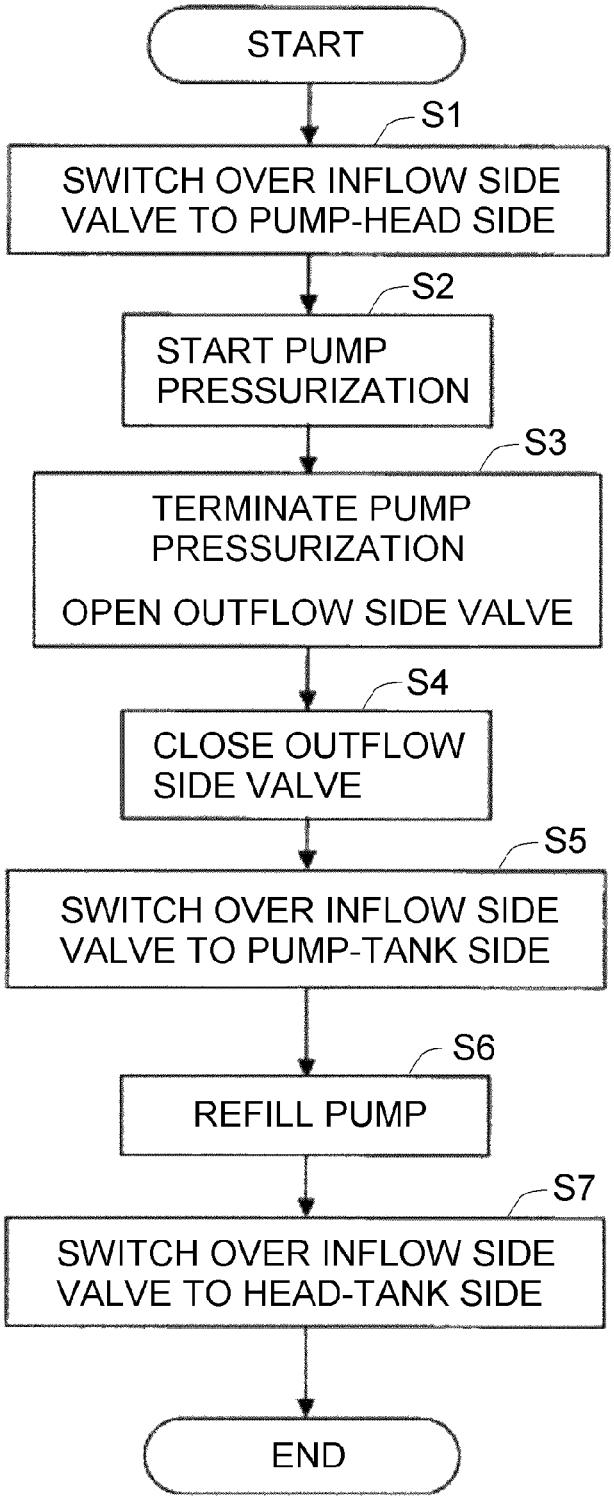
FIG. 11 is a flowchart illustrating a second sequence of steps of operation of removing air bubbles in the recording head 17.
Figure 12:
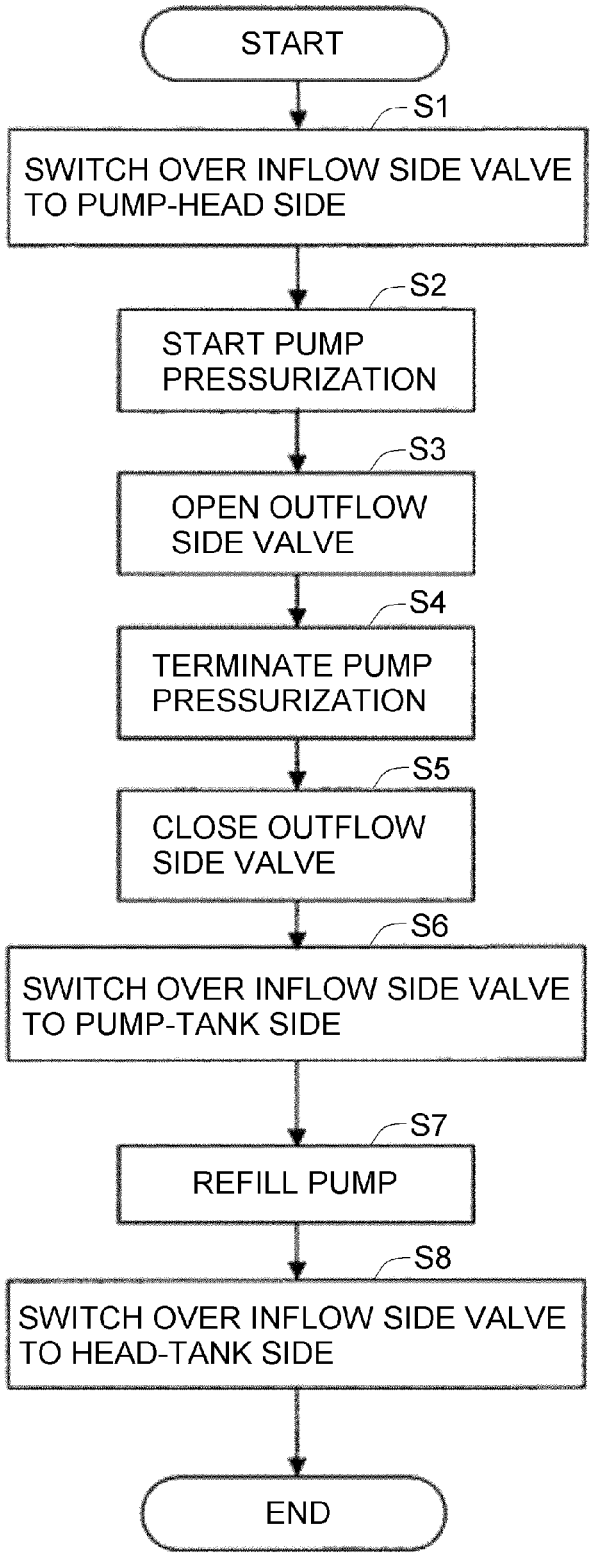
FIG. 12 is a flowchart illustrating a third sequence of steps of operation of removing air bubbles in the recording head 17.

FIG. 12 is a flowchart illustrating a third sequence of steps of operation of removing air bubbles in the recording head 17. In the procedure illustrated in FIG. 12, after the ink supply by the pressurization of the ink by the syringe pump 23 having been started (step S2), the outflow side valve 33 is opened (step S3) before the pressurization by the syringe pump 23 is terminated (step S4). Since the other controls are the same as those in FIG. 6 or FIG. 11, explanation thereof will be omitted.

By using the above procedure for making an operation of removing air bubbles in the recording head 17, the outflow side valve 33 can be positively opened before the ink supply by the syringe pump 23 is terminated, even if the time period from the start of the opening operation of the outflow side valve 33 to the termination thereof involves a time lag, and therefore, the control of the opening timing for the outflow side valve 33 can be easily performed. Further, since the outflow side valve 33 is opened for ejection of the ink before the pressurization of the ink by the syringe pump 23 is terminated, the time required for operation of removing air bubbles can be shortened.

Figure 13:
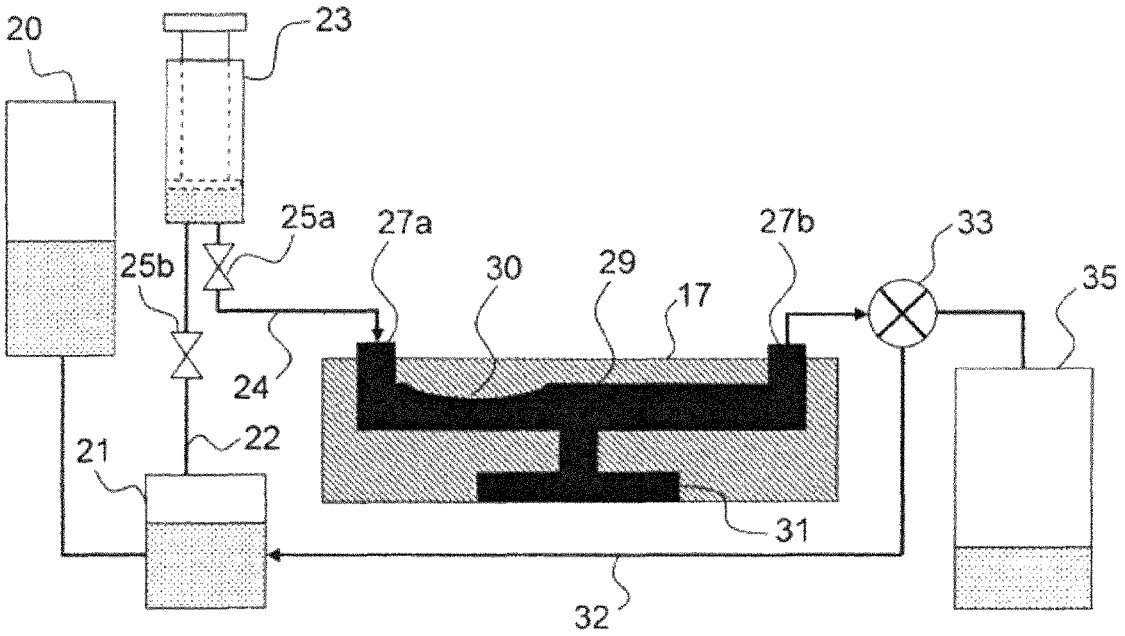
FIG. 13 is a drawing schematically showing another example of configuration of the ink-flow passage of the inkjet recording apparatus 100 of the present invention.

FIG. 13 is a drawing schematically showing another example of configuration of the ink-flow passage of the inkjet recording apparatus 100 of the present invention. In the present embodiment, the first ink-flow passage 22 and the second ink-flow passage 24 are provided independently of each other, and a first inflow side valve 25*a* comprised of a two-way valve is disposed in the second ink-flow passage 24, while a second inflow side valve 25*b* comprised of a two-way valve is disposed in the first ink-flow passage 22. The configuration of the other part is the same as that of the ink-flow passage shown in FIG. 3, and therefore, explanation thereof will be omitted.

Also in the configuration shown in FIG. 13, by making an operation of removing air bubbles with the same sequence of steps as that in FIG. 6, FIG. 11, or FIG. 12, occurrence of a reverse flow of the ink from the inflow port 27*a* toward the syringe pump 23 side is prevented, whereby the air bubbles B inside the common flow-passage 29 can be reliably carried away from the outflow port 27*b*.

The operation of removing air bubbles as described above can be performed simultaneously with an operation of recovering (purging) the recording head 17 by forcedly discharging the viscosity-increased ink, foreign matters, air bubbles, and the like in the nozzles 18 with the syringe pump 23 being used to pressurize the ink in the recording head 17 from the inflow port 27*a* side.

However, in a case where the air bubble removing operation is performed simultaneously with the purging operation, generation of air bubbles always involves a certain quantity of ink being discharged from the nozzles 18, and therefore a problem has been presented that the ink consumption in an operation other than the printing operation is increased. In addition, the ink in which air bubbles have been merely generated can be used for printing with substantially no problem if the air bubbles are removed, and therefore it is not always required to make a purging. Then, the air bubble removing mode in which only the air bubbles inside the common flow-passage 29 are removed without the ink being discharged from the nozzle 18 can be implemented separately of the purging operation.

Further, when the outflow side valve 33 is opened at step S4 in FIG. 6, and at step S3 in FIG. 11 and FIG. 12, the outflow side valve 33 is switched over such that, as shown in FIG. 9, the outflow port 27*b* of the recording head 17 and the sub-tank 21 are communicated with each other, whereby the ink carried away from the outflow port 27*b* together with the air bubbles can be reused, however, instead of this scheme, the outflow side valve 33 may be switched over such that the outflow port 27*b* and the waste fluid tank 35 are communicated with each other.

For example, in a case where the air bubble removing operation is performed simultaneously with the purging operation, communicating the outflow port 27*b* with the waste fluid tank 35 causes the ink inside the common flow-passage 29 to be recovered into the waste fluid tank 35, thereby the possibility being eliminated that the ink containing a viscosity-increased ink, foreign matters, and the like are reused. Accordingly, whether the outflow side valve 33 is switched over to the sub-tank 21 side, or to the waste fluid tank 35 side may be determined depending upon the condition of the ink in the common flow-passage 29.

Thus, the present invention is not limited to the above-stated embodiment, and may be variously modified within the scope of the spirit of the present invention. For example, the above-stated embodiment is configured such that the syringe pump 23 is used to supply the ink to the recording head 17, however, the method for supplying the ink at the time of printing is not specifically limited, provided that the ink is suppliable from the sub-tank 21 to the recording head 17. For example, an ink supply passage which connects between the sub-tank 21 and the recording head 17 not through the syringe pump 23 may be provided for supplying the ink from the sub-tank 21 to the recording head 17. In addition, a pump mechanism different from the syringe pump 23 may be used.

In addition, the main tank 20 and the waste fluid tank 35 are not indispensable components, and for example, with a smallsized inkjet recording apparatus, the sub-tank 21 may be replaced with another one when the ink in the sub-tank 21 is used up, the main tank 20 being not provided. In addition, instead of the waste fluid tank 35, a recovery tray for recovering the viscosity-increased ink or the ink including foreign matters that has been discharged from the nozzle 18 by the purging operation may be provided.

In addition, the number of nozzles 18 in the recording head 17, the nozzle-to-nozzle spacing, and the like, may be set as appropriate in accordance with the specifications for the inkjet recording apparatus 100. In addition, the number of recording heads 17 is not particularly limited, and for example, a single recording head 17 may be disposed for each of the line heads 11C to 11K.

The present invention is applicable to inkjet recording apparatuses which perform recording by discharging the ink from the recording head. By utilizing the present invention, the time required for recovering the recording head can be shortened, whereby there can be obtained an inkjet recording apparatus with which the user waiting time is shorter, and the usability is more excellent. In addition, an inkjet recording apparatus can be obtained which can suppress clogging of the ink discharge nozzle and poor printing due to sucking back a viscosity-increased ink or foreign matters discharged from the ink discharge nozzle.

What is claimed is:

1. An inkjet recording apparatus, comprising:

a recording head having a common flow-passage possessing an inflow port at one end and an outflow port at the other end, and a plurality of nozzles communicating with the common flow-passage and discharging ink onto a record medium;

an ink tank for reserving the ink to be discharged onto the record medium;

a pump mechanism for sucking the ink inside the ink tank and supplying the ink introduced by suction to the recording head;

a circulation flow passage having a first ink-flow passage connecting between the pump mechanism and the ink tank, a second ink-flow passage connecting between the pump mechanism and the inflow port of the recording head, and a third ink-flow passage connecting between the outflow port of the recording head and the ink tank;

an inflow side valve provided in the second ink-flow passage;

an outflow side valve provided in the third common flow passage; and a damper portion formed in the ink-flow passage from the inflow side valve to the outflow side valve for buffering a change in internal pressure caused by an operation of the pump mechanism, the inkjet recording apparatus being capable of implementing an operation of removing air bubbles in the recording head, the operation including:

the ink supply step of supplying the ink to the common flow-passage by using the pump mechanism for pressurizing the ink in the state in which movement of the ink inside the second ink-flow passage is tolerated with the inflow side valve, and movement of the ink inside the third ink-flow passage is restricted with the outflow side valve;

the ink ejection step of ejecting, after start of the ink supply step, the ink together with the air bubbles inside the common flow-passage from the outflow port into the third ink-flow passage by tolerating movement of the ink inside the third ink-flow passage with the outflow side valve; and the refilling step of, after termination of the ink ejection step, refilling the ink into the pump mechanism from the ink tank through the first ink-flow passage in the state in which movement of the ink inside the second ink-flow passage is restricted with the inflow side valve.

2. The inkjet recording apparatus according to claim 1, wherein the ink ejection step is started before the ink supply step is terminated.

3. The inkjet recording apparatus according to claim 1, wherein, after termination of the ink ejection step, movement of the ink inside the third ink-flow passage is restricted with the outflow side valve before the refilling step is started.

4. The inkjet recording apparatus according to claim 1, wherein an operation of removing air bubbles in the recording head is performed separately of an operation of recovering the recording head by forcedly discharging the ink from the plurality of nozzles.

5. The inkjet recording apparatus according to claim 1, wherein an operation of removing air bubbles in the recording head is performed together with an operation of recovering the recording head by forcedly discharging the ink from the plurality of nozzles.

6. The inkjet recording apparatus according to claim 1, wherein the outflow side valve is a three-way valve, and a waste fluid tank is connected to the third ink-flow passage through the outflow valve.

7. The inkjet recording apparatus according to claim 1, wherein the inflow side valve is a three-way valve, and the second ink-flow passage is connected to the first ink-flow passage through the inflow side valve.

8. A method for removing air bubbles in an inkjet recording apparatus, the inkjet recording apparatus including:

a recording head having a common flow-passage possessing an inflow port at one end and an outflow port at the other end, and a plurality of nozzles communicating with the common flow-passage;

an ink tank;

a pump mechanism for supplying ink inside the ink tank to the recording head;

a circulation flow passage having a first ink-flow passage connecting between the pump mechanism and the ink tank, a second ink-flow passage connecting between the pump mechanism and the inflow port of the recording head, and a third ink-flow passage connecting between the outflow port of the recording head and the ink tank;

an inflow side valve provided in the second ink-flow passage;

an outflow side valve provided in the third ink-flow passage; and a damper portion formed in the common flow-passage from the inflow side valve to the outflow side valve for buffering a change in internal pressure caused by an operation of the pump mechanism, the method comprising:

the ink supply step of supplying the ink to the common flow-passage by using the pump mechanism for pressurizing the ink in the state in which movement of the ink inside the second ink-flow passage is tolerated with the inflow side valve, and movement of the ink inside the third ink-flow passage is restricted with the outflow side valve;

the ink ejection step of ejecting, after start of the ink supply step, the ink together with the air bubbles inside the common flow-passage from the outflow port into the third ink-flow passage by tolerating movement of the ink inside the third ink-flow passage with the outflow side valve; and the refilling step of, after termination of the ink ejection step, refilling the ink into the pump mechanism from the ink tank through the first ink-flow passage in the state in which movement of the ink inside the second ink-flow passage is restricted with the inflow side valve.

9. The method for removing air bubbles in an inkjet recording apparatus according to claim 8, wherein the ink ejection step is started before the ink supply step is terminated.

10. The method for removing air bubbles in an inkjet recording apparatus according to claim 8, wherein, after termination of the ink ejection step, movement of the ink inside the third ink-flow passage is restricted with the outflow side valve before the refilling step is started.

11. The method for removing air bubbles in an inkjet recording apparatus according to claim 8, wherein an operation of removing air bubbles in the recording head is performed separately of an operation of recovering the recording head by forcedly discharging the ink from the plurality of nozzles.

12. The method for removing air bubbles in an inkjet recording apparatus according to claim 8, wherein an operation of removing air bubbles in the recording head is performed together with an operation of recovering the recording head by forcedly discharging the ink from the plurality of nozzles.

13. An inkjet recording apparatus, comprising:

a recording head having a common flow-passage possessing an inflow port at one end and an outflow port at the other end, and a plurality of nozzles communicating with the common flow-passage;

an ink tank;

a pump mechanism for supplying ink inside the ink tank to the recording head;

a circulation flow passage having a first ink-flow passage connecting between the pump mechanism and the ink tank, a second ink-flow passage connecting between the pump mechanism and the inflow port of the recording head, and a third ink-flow passage connecting between the outflow port of the recording head and the ink tank;

an inflow side valve provided in the second ink-flow passage;

an outflow side valve provided in the third ink-flow passage; and a damper portion formed in the common flow-passage from the inflow side valve to the outflow side valve for buffering a change in internal pressure caused by an operation of the pump mechanism, the inkjet recording apparatus being capable of implementing:

the ink supply step of supplying the ink to the common flow-passage by using the pump mechanism for pressurizing the ink in the state in which movement of the ink inside the second ink-flow passage is tolerated with the inflow side valve, and movement of the ink inside the third ink-flow passage is restricted with the outflow side valve;

the ink ejection step of ejecting, after start of the ink supply step, the ink together with air bubbles inside the common flow-passage from the outflow port into the third ink-flow passage by tolerating movement of the ink inside the third ink-flow passage with the outflow side valve; and the refilling step of, after termination of the ink ejection step, refilling the ink into the pump mechanism from the ink tank through the first ink-flow passage in the state in which movement of the ink inside the second ink-flow passage is restricted with the inflow side valve.

14. The inkjet recording apparatus according to claim 13, wherein the ink ejection step is started before the ink supply step is terminated.

15. The inkjet recording apparatus according to claim 13, wherein, after termination of the ink ejection step, movement of the ink inside the third ink-flow passage is restricted with the outflow side valve before the refilling step is started.

16. The inkjet recording apparatus according to claim 13, wherein an operation of removing air bubbles in the recording head is performed separately of an operation of recovering the recording head by forcedly discharging the ink from the plurality of nozzles.

17. The inkjet recording apparatus according to claim 13, wherein an operation of removing air bubbles in the recording head is performed together with an operation of recovering the recording head by forcedly discharging the ink from the plurality of nozzles.

* * * * *